US009437988B2

(12) United States Patent
McGrath et al.

(10) Patent No.: US 9,437,988 B2
(45) Date of Patent: Sep. 6, 2016

(54) ELECTRICAL CONNECTOR

(71) Applicants: Tyco Electronics Corporation, Berwyn, PA (US); Tyco Electronics Japan G.K., Kanagawa (JP)

(72) Inventors: James L. McGrath, Barrington, IL (US); Takeshi Nakashima, Kanagawa (JP); Izumi Hasegawa, Kanagawa (JP); Isao Igarashi, Tokyo (JP)

(73) Assignees: Tyco Electronics Corporation, Berwyn, PA (US); Tyco Electronics Japan G.K. (JP)

( * ) Notice: Subject to any disclaimer, the term of this patent is extended or adjusted under 35 U.S.C. 154(b) by 0 days.

(21) Appl. No.: 14/517,179

(22) Filed: Oct. 17, 2014

(65) Prior Publication Data

US 2016/0111833 A1 Apr. 21, 2016

(51) Int. Cl.
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
USPC ..... 439/676, 108, 489, 607.4, 79, 607.05
See application file for complete search history.

(56) References Cited

U.S. PATENT DOCUMENTS 5,895,276 A 4/1999 Rothenberger
6,280,209 B1 8/2001 Bassler et al.
6,350,134 B1 * 2/2002 Fogg et al. ..... 439/79
6,454,605 B1 9/2002 Bassler et al.
6,457,983 B1 * 10/2002 Bassler et al. ..... 439/101
6,638,111 B1 * 10/2003 McDaid et al. ..... 439/607.09
6,863,549 B2 3/2005 Brunker et al.
6,923,664 B2 * 8/2005 Ito et al. ..... 439/108
7,413,467 B1 * 8/2008 Lai et al. ..... 439/489
7,488,188 B2 * 2/2009 Moriyama et al. ..... 439/108
7,806,704 B2 * 10/2010 Miyoshi et al. ..... 439/108
7,824,193 B2 * 11/2010 Oyake et al. ..... 439/79
7,841,905 B2 * 11/2010 Zheng et al. ..... 439/660

(Continued)

FOREIGN PATENT DOCUMENTS

JP 8315916 A 11/1996
JP 200780782 A 3/2007

(Continued)

OTHER PUBLICATIONS

PCT International Preliminary Report on Patentability, International Application No. PCT/JP2013/052181, dated Oct. 14, 2014, 5 pages.

*Primary Examiner* — Alexander Gilman

(57) ABSTRACT

An electrical connector is provided with a first ground contact and a second ground contact. The first ground contact includes a first ground coupling portion and a pair of first ground contact portions extending substantially orthogonal from the first ground coupling portion. The pair of first ground contact portions includes a first upper ground contact portion stepped from a first lower ground contact portion. The second ground contact includes a second ground coupling portion and a pair of second ground contact portions extending substantially orthogonal from the second ground coupling portion. The pair of second ground contact portions includes a second upper ground contact portion stepped from a second lower ground contact portion. The second ground contact is positioned with the first ground contact such that their respective upper or lower ground contact portions are adjacent to each other.

32 Claims, 5 Drawing Sheets

(56) References Cited

U.S. PATENT DOCUMENTS

| | | | | |
|---|---|---|---|---|
| 8,025,532 | B2 * | 9/2011 | Nagata et al. | 439/607.4 |
| 8,100,720 | B2 * | 1/2012 | Lin et al. | 439/607.34 |
| 9,065,214 | B2 * | 6/2015 | Nakashima et al. | |
| 2005/0048846 | A1 * | 3/2005 | Suzuki et al. | 439/660 |
| 2010/0173524 | A1 * | 7/2010 | Zhu et al. | 439/607.01 |
| 2010/0173529 | A1 * | 7/2010 | He et al. | 439/660 |
| 2010/0248515 | A1 * | 9/2010 | Kondo et al. | 439/218 |
| 2011/0104915 | A1 * | 5/2011 | Lin et al. | 439/108 |
| 2012/0315796 | A1 * | 12/2012 | Pang et al. | 439/626 |
| 2015/0031242 | A1 | 1/2015 | Hasegawa et al. | |

FOREIGN PATENT DOCUMENTS

| | | | |
|---|---|---|---|
| JP | 2010157505 | A | 7/2010 |
| JP | 2010238409 | A | 10/2010 |
| JP | 201140224 | A | 2/2011 |

* cited by examiner

ELECTRICAL CONNECTOR

FIELD OF THE INVENTION

The invention generally relates to an electrical connector and, more specifically, to an electrical connector suitable for differential signal transmission.

BACKGROUND

In the fields of digital data transmission and communication requiring high-speed signal transmission, differential signal transmission is becoming widely used, and there is consumer demand for reduced size electronic devices used in transmitting high-speed differential signals. Electrical connectors used in such electronic devices also are desired to have smaller profiles.

SUMMARY

In view of the problems described above, among others, an electrical connector is provided with a first ground contact and a second ground contact. The first ground contact includes a first ground coupling portion and a pair of first ground contact portions extending substantially orthogonal from the first ground coupling portion. The pair of first ground contact portions includes a first upper ground contact portion stepped from a first lower ground contact portion. The second ground contact includes a second ground coupling portion and a pair of second ground contact portions extending substantially orthogonal from the second ground coupling portion. The pair of second ground contact portions includes a second upper ground contact portion stepped from a second lower ground contact portion. The second ground contact is positioned with the first ground contact such that their respective upper or lower ground contact portions are adjacent to each other.

BRIEF DESCRIPTION OF THE DRAWINGS

The invention will now be described by way of example with reference to the accompanying Figures, of which.

DETAILED DESCRIPTION OF THE EMBODIMENT(S)

The invention is described below by way of exemplary embodiments with reference to the attached drawings.

Figure 1:
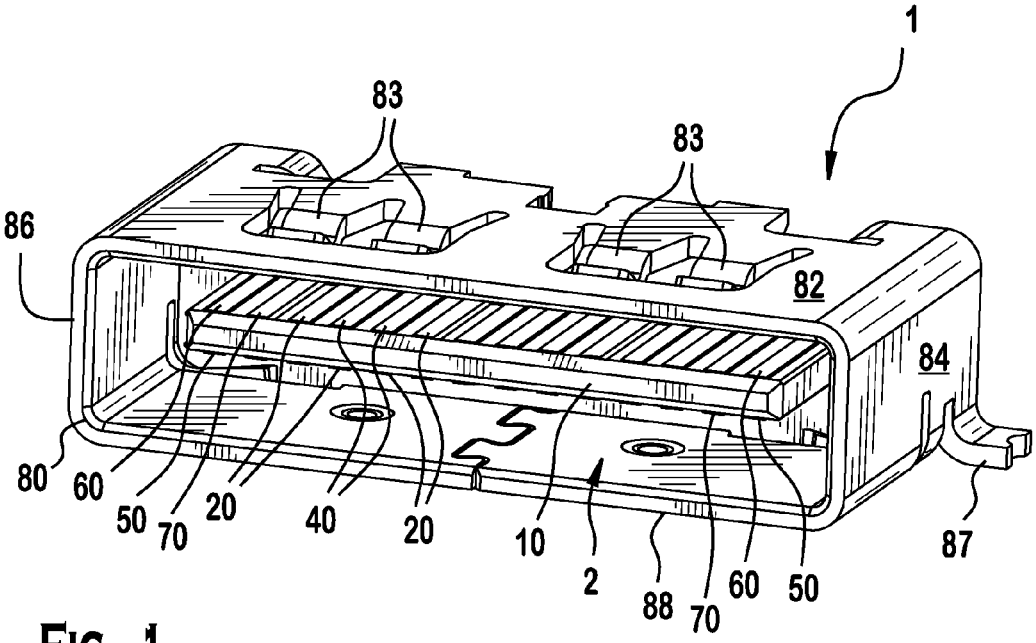
FIG. 1 is a front perspective view of an electrical connector according to an embodiment of the invention.
Figure 2:
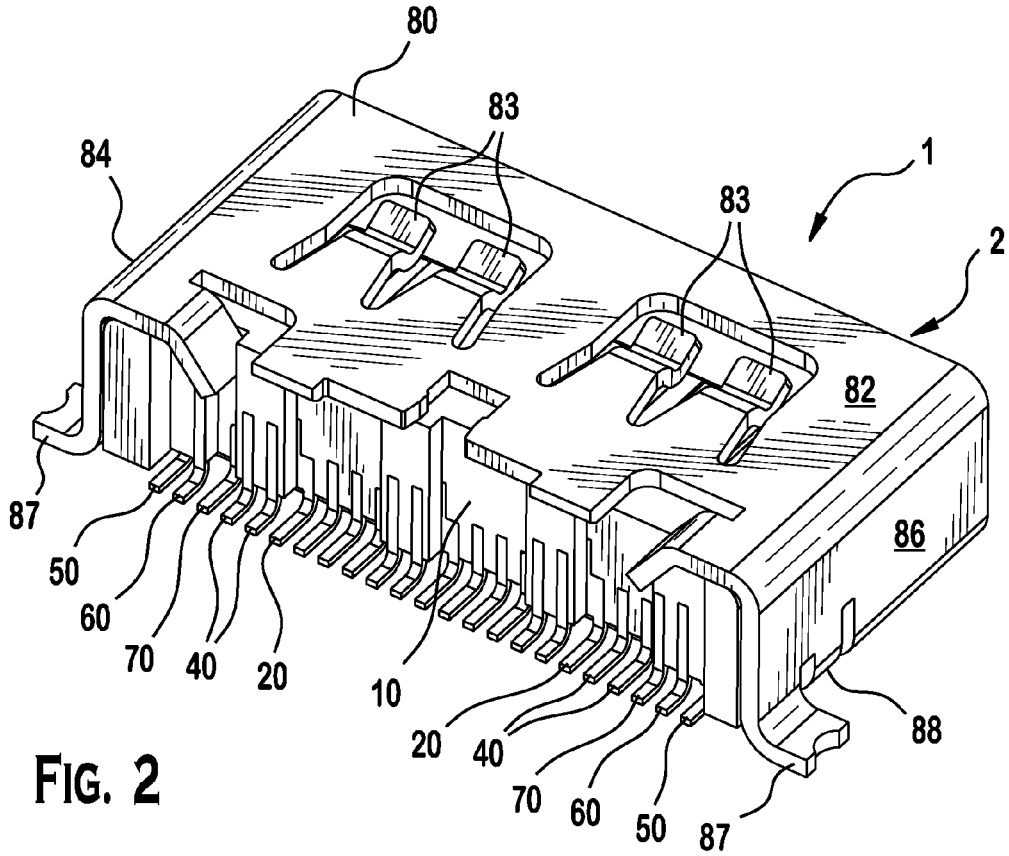
FIG. 2 is a rear perspective view of the electrical connector of FIG. 1.

With reference to FIGS. 1 and 2, an exemplary embodiment of an electrical connector 1 according to the invention is shown. The electrical connector 1, which may be a receptacle connector, is mountable to a circuit board (not shown), and includes a contact support 10, a plurality of ground contacts 20, a plurality of signal contacts 40, a plurality of power contacts 50, a plurality of power ground contacts 60, a plurality of outer ground contacts 70, and a shell 80.

As shown in FIGS. 1 and 2, the shell 80 includes an upper wall 82, a first side wall 84, a second side wall 86, and a lower wall 88. A plurality of latches 83 are formed along the upper wall 82 to make contact with a shell (not shown) of a corresponding mating connector (not shown). However, one should appreciate that the use of latches 83 is an exemplary embodiment of a plug securing device, and other fasteners know to the art are possible. Additionally, solder feet 87 may be provided along the first and second side walls 84 and 86. The solder feet 87 extend from terminal end portions thereof. In an exemplary embodiment, the solder feet 87 may be soldered to the circuit board (not shown). In an exemplary embodiment, the shell 80 may be integrally formed by stamping and forming a conductive metal plate. In other embodiments, the shell may be formed using other methods and made of other conductive materials, and/or the solder feet 87 may be replaced with other fastening mechanisms such as through posts, etc.

Figure 3:
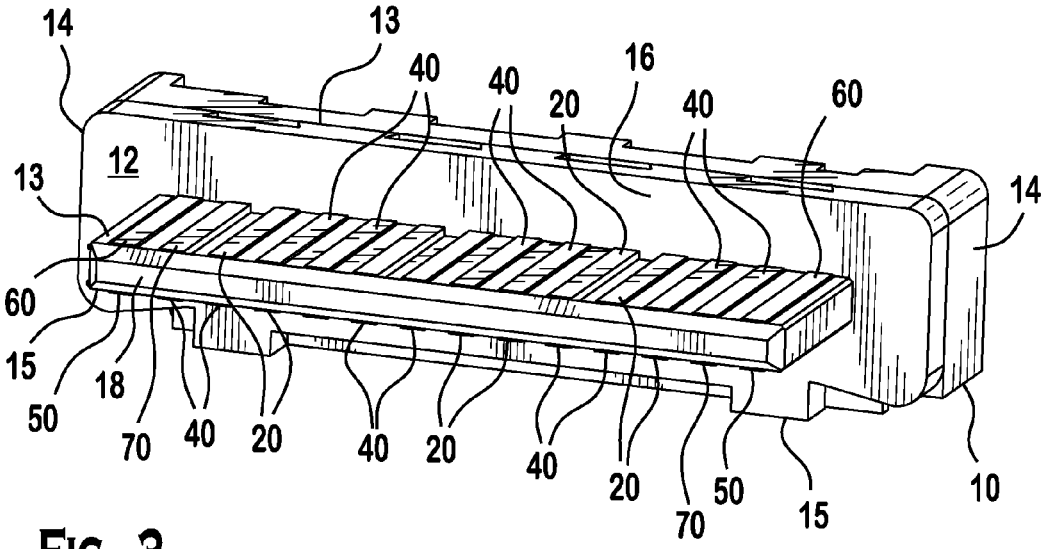
FIG. 3 is a front perspective view of the electrical connector of FIG. 1 with a shell removed.
Figure 4:
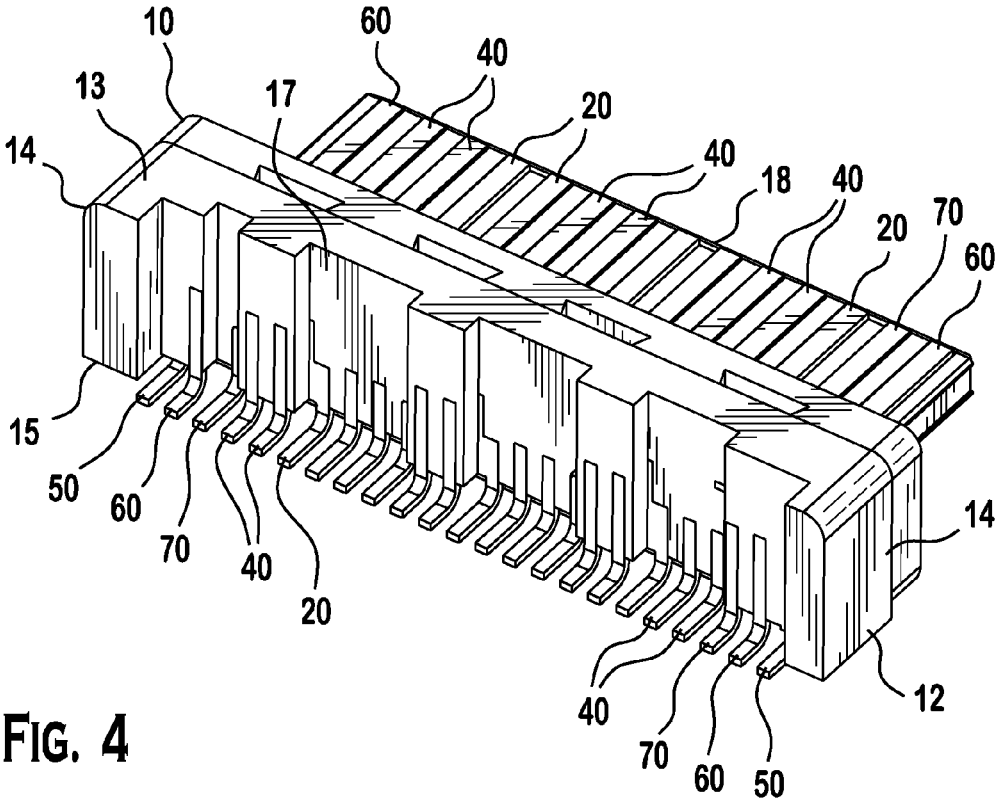
FIG. 4 is a rear perspective view of the electrical connector of FIG. 3.
Figure 5:
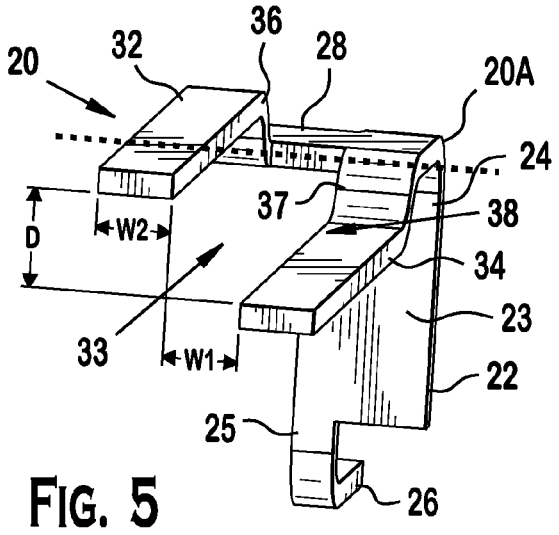
FIG. 5 is a perspective view of a first ground contact of the electrical connector of FIG. 1.
Figure 6:
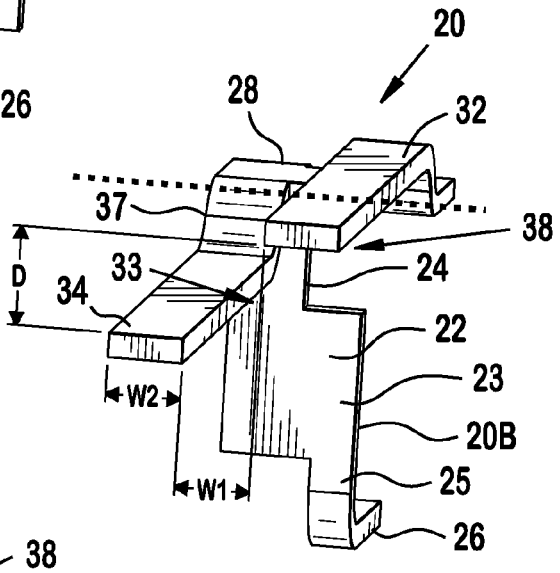
FIG. 6 is a perspective view of a second ground contact of the electrical connector of FIG. 1.
Figure 7:
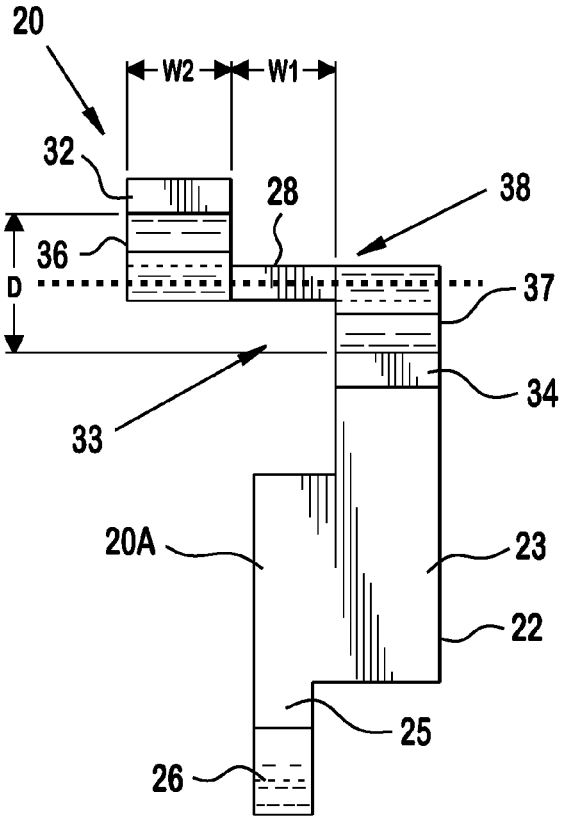
FIG. 7 is a front view of the first ground contact of FIG. 5.
Figure 8:
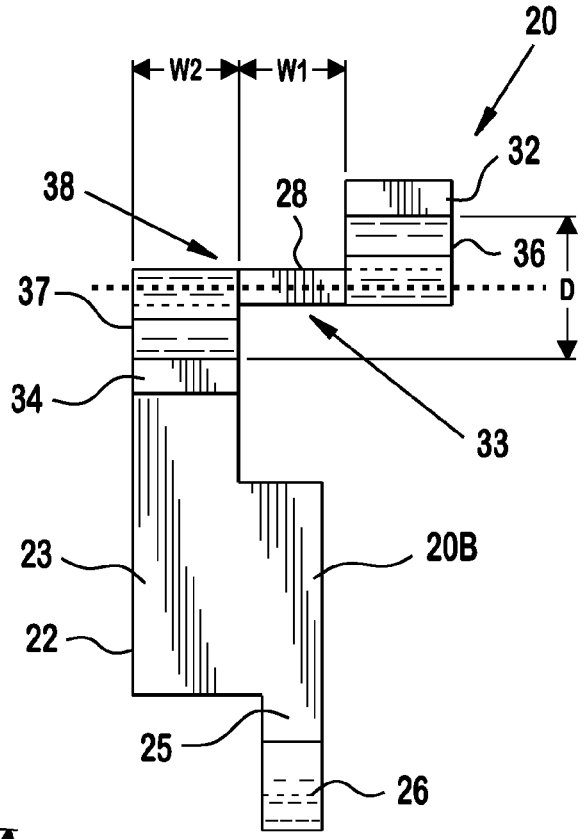
FIG. 8 is a front view of the second ground contact of FIG. 6.

Now with reference to FIGS. 3 and 4, an exemplary embodiment of the contact support 10 is shown. The contact support 10, which is made of an insulative material, includes a main body 12 and a tongue 18. As shown, the contact support 10 is generally rectangular shaped and includes an upper surface 13, side surfaces 14, a lower surface 15, a front surface 16, and a rear surface 17. The tongue 18 is a planar insulative member extending from the front surface 16 of the main body 12. The tongue 18 is positioned substantially orthogonal to the front surface 16 and includes an upper surface 13 and a lower surface 15.

Next, with reference to FIGS. 5-8, the plurality of ground contacts 20 will be described. For the electrical connector 1 according to the invention, the plurality of ground contacts 20 includes at least one first ground contact 20A and at least one second ground contact 20B. In an exemplary embodiment, each ground contact 20 (20A, 20B) includes a coupling portion 22, terminating portion 26, a base portion 28, and a pair of contact portions 32, 34. It should be recognized that terminating portion 26 in various embodiments may be a surface mount terminal, through post, or other mechanism for soldering or attaching to the circuit board. Each ground contact 20 (20A, 20B) is preferably formed by stamping and forming a conductive metal plate. When stamped, the metal blank for each ground contact 20 (20A, 20B) has the same shape in a specific embodiment. However, during the forming process, the terminating portion 26, the base portion 28, and the pair of contact portions 32, 34 are angled or bent differently depending on the type of ground contact 20 (20A, 20B), as will be discussed in more detail below. Accordingly, manufacturing of the ground contacts 20 (20A, 20B) is simplified and cost efficient. In other embodiments, the ground contacts 20 may be formed using other methods and made of other conductive materials besides metal.

The coupling portion 22 includes body 23, a base extension 24, and a terminal extension 25. The body 23 is substantially square shaped in the embodiment shown. However, one skilled in the art should appreciate that the body 23 may take other shapes, for instance, a generally rectangular or other shape. The base extension 24 extends from one end of the body 23, while the terminal extension 25 extends from an opposite end of the body 23. As shown, the base extension 24 is obliquely positioned with respect to the terminal extension 25. In addition, as shown for a specific embodiment, the base extension 24 is wider than terminal extension 25. The base extension 24 for the first ground contact 20A is positioned on a first side (e.g., right side) of the body 23, while the base extension 24 for the second ground contact 20B is positioned on the other side (e.g., left side) of its body 23. Likewise, the terminal extension 25 for the first ground contact 20A is positioned on the second side (e.g., left side) of the body 23, while the terminal extension 25 for the second ground contact 20B is positioned on the other side (e.g., right side) of its body 23. Accordingly, the first ground contact 20A mirrors the second ground contact 20B.

As shown in FIGS. 5-8, the base portion 28 is an elongated member that is angled or bent with respect to the base extension 24. The base portion 28 extends substantially orthogonal to the coupling portion 22. As shown, the base portion 28 includes an upward portion 36 extending upwardly from one side of the base portion 28 and a downward portion 37 extending downwardly from the other side of the base portion 28. The upward portion 36 and the downward portion 37 are positioned at distal and proximal ends, respectively, of base portion 28. The base portion 28 connects to the pair of contact portions 32, 34 via the upward portion 36 and the downward portion 37.

In an exemplary embodiment, the contact portions 32, 34 are rectangular and tabular shaped, orthogonal from the coupling portion 22 to extend parallel to the main surface of the circuit board (not shown) where the electrical connector 1 is to be mounted. The contact portions 32, 34 are spaced apart from each other with a gap 33 having a width W1. In the shown embodiment, the terminal extension 25 is centered with respect to the width W1. The gap 33 extends between the mating ends of the contact portions 32, 34. The contact portions 32, 34 of the ground contacts 20A and 20B have the same width W2. In addition, since the contact portions 32, 34 are connected to each other via the upward portion 36 and the downward portion 37 of the base portion 28, the contact portions 32, 34 are said to be stepped from each other or staggered with respect to a horizontal axis (shown in dotted line) along the base portion 28. Accordingly, a tongue receiving space 38 having height D between the contact portions 32, 34 is provided.

Figure 9:
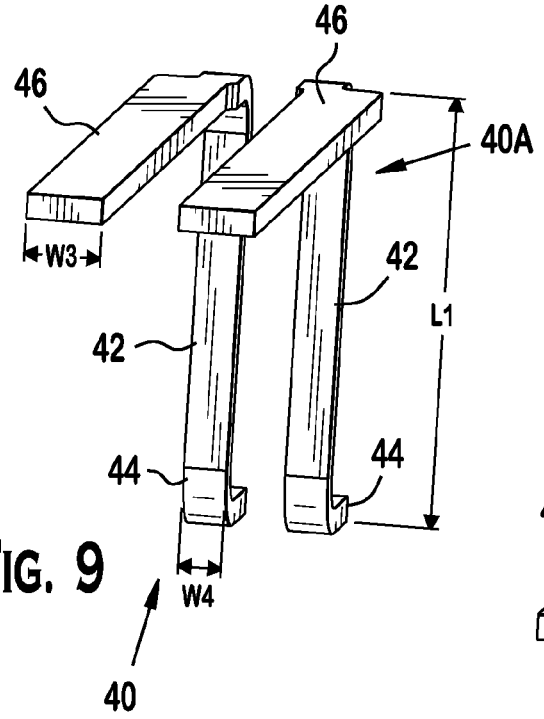
FIG. 9 is a perspective view of a pair of first signal contacts of the electrical connector of FIG. 1.
Figure 10:
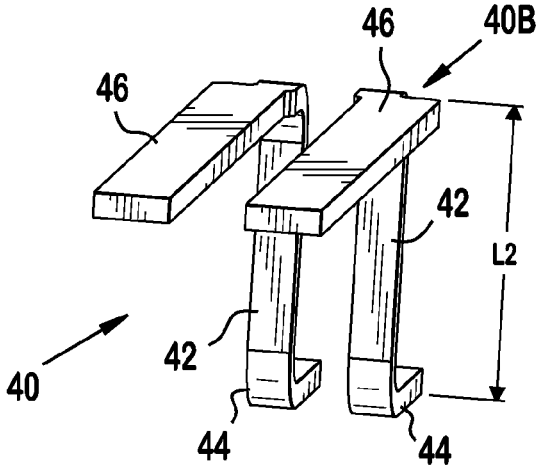
FIG. 10 is a perspective view of a pair of second signal contacts of the electrical connector of FIG. 1.

Next, with reference to FIGS. 9 and 10, the plurality of signal contacts 40 will be described. For the electrical connector 1 according to an embodiment of the invention, the plurality of signal contacts 40 includes a pair of first signal contacts 40A and a pair of second signal contacts 40B. In an exemplary embodiment, each signal contact 40 (40A, 40B) includes a body portion 42, a terminating portion 44, and a contact portion 46. Each signal contact 40 (40A, 40B) may be preferably formed by stamping and forming a conductive metal plate. Each signal contact 40 (40A, 40B) is used for differential signal transmission. In other embodiments, the signal contacts 40 may be formed using other methods and made of other conductive materials besides metal. It should be recognized that terminating portion 44 in various embodiments may be a surface mount terminal, through post, or other mechanism for soldering or attaching to the circuit board.

The body portion 42 is an elongated body having a leading end connecting to the contact portion 46 and a trailing end connecting to the terminating portion 44. The length L1 of the body portion 42 for the signal contact pair 40A is different from the length L2 of body portion 42 of the signal contact pair 40B. Therefore, the contact portions 46 for the signal contact pair 40A and 40B have different heights when terminating portions 44 of signal contacts 40A and 40B are attached to the circuit board. The terminating portion 44 and the contact portion 46 extend in opposite directions. As shown, the contact portion 46 is generally rectangular and tabular shaped, orthogonal from the body portion 42 to extend parallel to the main surface of the circuit board, and has a width W3 that is larger than a width W4 of body portion 42 and the terminating portion 44.

Figure 11:
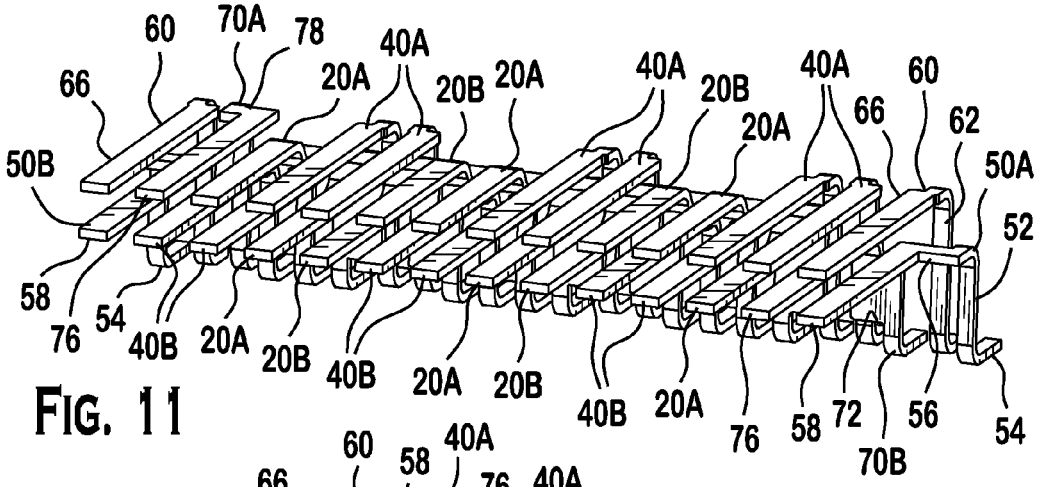
FIG. 11 is a perspective view of the electrical connector of FIG. 3 with the shell and a body removed.
Figure 12:
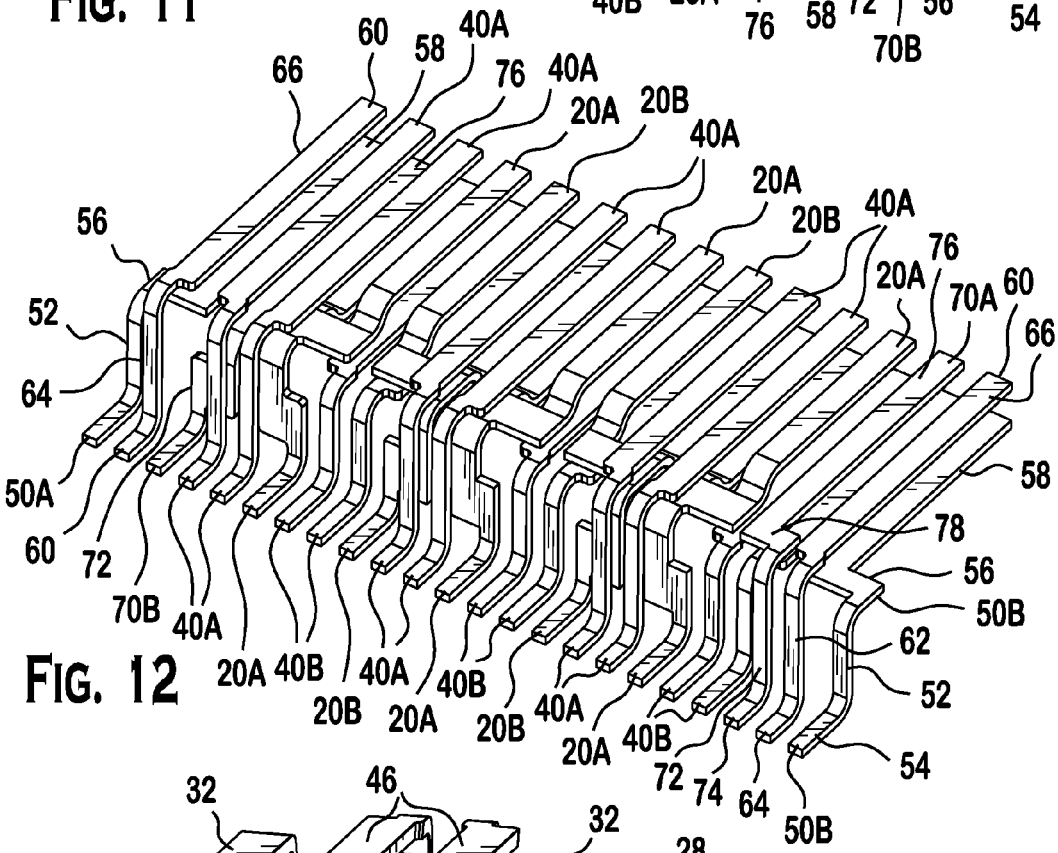
FIG. 12 is a perspective view of the electrical connector of FIG. 4 with the shell and the body removed.

As shown in FIGS. 11 and 12, the electrical connector 1 according to the invention includes a plurality of power contacts 50 and a plurality of power ground contacts 60.

In an exemplary embodiment shown in FIGS. 11 and 12, each power contact 50 includes a body portion 52, a terminating portion 54, a base portion 56, and a contact portion 58. Each power contact 50 is formed by stamping and forming a conductive metal plate. When stamped each power contact 50 has the same shape. However, during the forming process, the terminating portion 54, the base portion 56, and the contact portion 58 are bent differently depending on the type of power contact 50, as will be discussed in more detail below. In other embodiments, the power contacts 50 may be formed using other methods and made of other conductive materials besides metal. It should be recognized that terminating portion 54 in various embodiments may be a surface mount terminal, through post, or other mechanism for soldering or attaching to the circuit board.

The body portion 52 is an elongated body having a leading end connecting to the base portion 56 and a trailing end connecting to the terminating portion 54. The base portion 56 is an elongated member bent from body portion 52. The length of the body portion 52 of the power contacts 50 is substantially the same as the length of body portion 42 of the signal contacts 40B in the embodiment shown. The base portion 56 extends substantially orthogonal to the body portion 52. As shown, the base portion 56 includes a proximal end that connects to the body portion 52 and a trailing end that connects to the contact portion 58. Accordingly, the contact portion 58 is offset from the body portion 52 and the terminating portion 54. The terminating portion 54 and the contact portion 58, both angled or bent from the body portion 52, extend in opposite directions from each other.

In an exemplary embodiment, each power ground contact 60 includes a body portion 62, a terminating portion 64, and a contact portion 66. Each power ground contact 60 is formed by stamping and forming a conductive metal plate. When stamped each power ground contact 60 has the same shape. However, during the forming process, the terminating portion 64 and the contact portion 66 are bent differently depending on the type of power ground contact 60, as will be discussed in more detail below. In other embodiments, the power ground contacts 60 may be formed using other methods and made of other conductive materials besides metal. It should be recognized that the terminating portion 64 in various embodiments may be a surface mount terminal, through post, or other mechanism for soldering or attaching to the circuit board.

The body portion 62 is an elongated body having a leading end connecting to the contact portion 66 and a trailing end connecting to the terminating portion 64. The length of the body portion 62 is substantially the same as the length of body portion 42 of the signal contacts 40A in the embodiment shown.

One skilled in the art would appreciate that the power contact 50 and the power ground contract 60 could be reversed depending on the arrangement of the power contact 50 and the power ground contact 60 along the tongue 18, as will be described below. For instance, the power ground contact 60 may have the aforementioned design of the power contact 50, while the power contact 50 may have the aforementioned design of the power ground contact 60.

Additionally, as shown in FIGS. 11 and 12, the electrical connector 1 according to an exemplary embodiment of the invention may include a plurality of outer ground contacts 70 (70A, 70B). The outer ground contact 70 (70A, 70B) is formed by stamping and forming a conductive metal plate. In other embodiments, the outer ground contact 70 (70A, 70B) may be formed using other methods and made of other conductive materials besides metal.

In the shown embodiment, each outer ground contact 70 (70A, 70B) includes a body portion 72, a terminating portion 74, and a contact portion 76. It should be recognized that terminating portion 74 in various embodiments may be a surface mount terminal, through post, or other mechanism for soldering or attaching to the circuit board. The body portion 72 is an elongated body having a leading end extending to the contact portion 76 and a trailing end extending to the terminating portion 74. The terminating portion 74 and the contact portion 76, are both bent to be angled from the body portion 72, and to extend generally in opposite directions from each other. As shown, the contact portion 76 is offset from the body portion 72 and the terminating portion 74. In particular, for the outer ground contact 70A, the contact portion 76 is offset from the terminating portion 74 through a base portion 78 that connects the body portion 72 and the contact portion 76. However, the outer ground contact 70B body portion 72 is substantially square shaped in the embodiment shown. One skilled in the art should appreciate that the body portion 72 may take other shapes, for instance, generally rectangular or other shapes.

Figure 13:
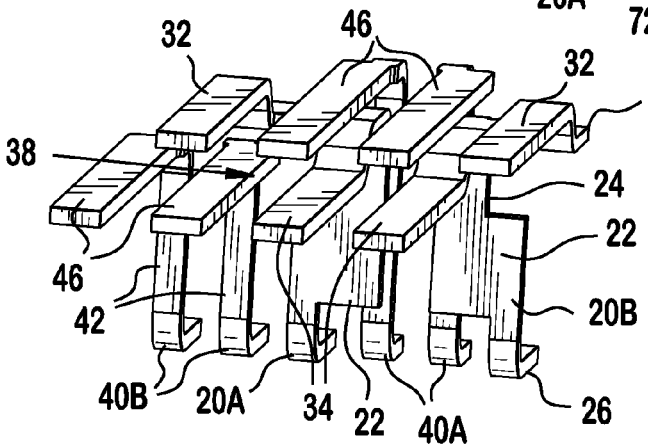
FIG. 13 is a close-up perspective view of an arrangement of a plurality of signal contacts and ground contacts within the electrical connector of FIG. 11 according to a specific embodiment of the invention.

Now with reference to FIGS. 11-13, an assembly and arrangement of the ground, signal, and power contacts 20, 40, 50 for the electrical connector 1 according to an exemplary embodiment of the invention will be discussed. In general, the plurality of ground contacts 20 and signal contacts 40 are arranged on the contact support 10 and the shell 80 is positioned over and around the contact support 10 to provide a cover around the contact support 10 (refer to FIGS. 1-4). Additionally, the power contacts 50, the power ground contacts 60, and the outer ground contact 70 are also arranged along the contact support 10. As shown, each contact 20, 40, 50, 60, and 70 are over molded with the contact support 10.

A mating connector receiving passageway 2 is provided and defined by an opening along a front side of the shell 80. The mating connector receiving passageway 2 (seen in FIG. 1) is sized to receive a mating connector (not shown).

The contact portions 32, 34 of the ground contacts 20A and 20B and the contact portions 46 of the signal contacts 40A, 40B are arranged on the contact support 10 in the mating connector receiving passageway 2. In particular, the contact portions 32, 34 of the ground contacts 20A and 20B and the contact portions 46 of the first and second signal contacts 40A, 40B are arranged on the upper and lower surfaces of the tongue 18.

The contact portions 32 of the ground contacts 30 (30A, 30B) are positioned on the first or upper surface of the tongue 18, while the contact portions 34 of the ground contacts 30 (30A, 30B) are positioned on the opposite or lower surface of the tongue 18. The contact portion 46 of the first signal contact 40A is positioned on the upper surface of the tongue 18, while the contact portion 46 of the second signal contact 40B is positioned on the lower surface of the tongue 18. In the embodiment shown, the contact portions 58 of the power contacts 50 both are positioned on the lower surface of the tongue 18. However, in other embodiments, contact portions 58 of the power contacts 50 both may be positioned on the upper surface of the tongue 18; or contact portion 58 of one power contact 50 may be positioned on the upper surface of the tongue 18 while contact portion 58 of another power contact 50 may be positioned on the lower surface of tongue 18.

In an exemplary embodiment, the pair of first signal contacts 40A are positioned adjacent to each other, with a ground contact 20A positioned adjacent to one of the pair of first signal contacts 40A and a ground contact 20B positioned adjacent to the other of the pair of first signal contacts 40A. Accordingly, the coupling portions 22 of the ground contacts 20A, 20B are parallel to and cover the body portions 42 of the pair of first signal contacts 40A, and contact portions 32 of ground contacts 20A,20B are positioned adjacent to the contact portions 46 of the first signal contacts 40A. Therefore, since the coupling portions 22 of the ground contacts 20A, 20B cover the body portions 42 of the pair of first signal contacts 40A, noise from other paired differential signal contacts (i.e. signal contacts 40B) can be suppressed, thereby achieving favorable signal transmission performance.

Additionally, the contact portions 34 are positioned under and face the contact portions 46 of the first signal contacts 40A. Since the contact portions 32, 34 are stepped from each other, the tongue receiving space 38 is provided between the contact portions 32, 34 and the contact portions 46 of the first signal contacts 40A.

In the embodiment shown, one second signal contact 40B is positioned adjacent to the ground contact 20A and another second signal contact 40B is positioned adjacent to the ground contact 20B. In particular, the body portion 42 of the second signal contact 40B is positioned adjacent to the coupling portion 22 of the ground contact 20A. In addition, the body portion 42 of the other second signal contact 40B is positioned adjacent to the coupling portion 22 of the ground contact 20B. The length of the body portion 42 of the second signal contacts 40B is shorter than the coupling portions 22 of the ground contacts 20 (20A, 20B) and the body portions 42 of first signal contacts 40A. When arranged adjacent to the ground contacts 20 (20A, 20B), the contact portions 46 of the second signal contacts 40B are positioned under and face the contact portions 32 of the ground contacts 20 (20A, 20B).

Accordingly, the contact portions 32 of ground contacts 20 and the contact portions 46 of first signal contacts 40A are spaced from each other and positioned on the upper surface of tongue 18; while contact portions 34 of ground contacts 20 and contact portions 46 of second signal contacts 40B are spaced from each other and positioned on the lower surface of tongue 18.

The described arrangement of the first ground contact 20A, the second ground contact 20B, the first signal contacts 40A, and the second signal contacts 40B may be sequentially repeated across the tongue 18. The number of sequential units will depend on the number of contacts desired for the particular application for the electrical connector 1. In the embodiment shown in FIGS. 11-12, the electrical connector 1 utilizes two sequential sets of a pair of second signal contacts 40B, first ground contact 20A, a pair of the second ground contact 20B, and the first signal contacts 40A shown in FIG. 13.

In the embodiment shown in FIGS. 11 and 12, the outer ground contacts 70 (70A, 70B) are positioned along opposite ends of the arrangement of ground contacts 20 and signal contacts 40. The outer ground contact 70A is positioned on the upper surface of the tongue 18, while the outer ground contact 70B is positioned on the lower surface of the tongue 18. In particular, in the shown embodiment, the outer ground contact 70 is positioned adjacent the contact portions 32 of separate first ground contacts 20A at opposing ends of the arrangement.

The power contacts 50 are positioned at opposite ends of the discussed arrangement and positioned on the lower surface of the tongue 18. The power ground contacts 60 are also positioned at opposite ends of the discussed arrangement and positioned on the upper surface of the tongue 18 and correspond with the power contacts 50.

Although exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector comprising:

a first ground contact having a first ground coupling portion and a pair of first ground contact portions extending substantially orthogonal from the first ground coupling portion, the pair of first ground contact portions having a first upper ground contact portion and a first lower ground contact portion, the first upper ground contact portion stepped from the first lower ground contact portion; and a second ground contact having a second ground coupling portion and a pair of second ground contact portions extending substantially orthogonal from the second ground coupling portion, the pair of second ground contact portions having a second upper ground contact portion and a second lower ground contact portion, the second upper ground contact portion stepped from the second lower ground contact portion, the second ground contact positioned with respect to the first ground contact such that either the first lower ground contact portion is positioned adjacent to the second lower ground contact portion or the first upper ground contact portion is positioned adjacent to the second upper ground contact portion.

2. The electrical connector according to claim 1, wherein the pair of first ground contact portions are spaced apart from each other along a width of the first ground contact.

3. The electrical connector according to claim 2, wherein the first ground contact includes a first ground terminating portion extending from the first ground coupling portion and extending in an opposite direction from the pair of first ground contact portions.

4. The electrical connector according to claim 3, wherein the first ground terminating portion is aligned between the pair of first ground contact portions.

5. The electrical connector according to claim 4, wherein a width of the first ground coupling portion is greater than a width of the first ground terminating portion.

6. The electrical connector according to claim 5, wherein the width of the first ground coupling portion is greater than a width of the first lower ground contact portion.

7. The electrical connector according to claim 6, wherein the width of the first ground coupling portion is greater than a width of the first upper ground contact portion.

8. The electrical connector according to claim 2, wherein the pair of second ground contact portions are spaced apart from each other along a width of the second ground contact.

9. The electrical connector according to claim 3, wherein the second ground contact includes a second ground terminating portion extending from the second ground coupling portion and extending in opposite direction than the pair of second ground contact portions.

10. The electrical connector according to claim 9, wherein the second ground terminating portion is aligned between the pair of second ground contact portions.

11. The electrical connector according to claim 9, wherein a width of the second ground coupling portion is greater than a width of the second ground terminating portion.

12. The electrical connector according to claim 11, wherein the width of the second ground coupling portion is greater than a width of the second lower ground contact portion.

13. The electrical connector according to claim 12, wherein the width of the second ground coupling portion is greater than a width of the second upper ground contact portion.

14. The electrical connector according to claim 1, further comprising a first ground body portion connecting the first pair of ground contact portions and the first ground coupling portion.

15. The electrical connector according to claim 14, wherein the first ground body portion extends substantially orthogonal to the first pair of ground contact portions and the first ground coupling portion.

16. The electrical connector according to claim 1, further comprising a second ground body portion connecting the pair of second ground contact portions and the second ground coupling portion.

17. The electrical connector according to claim 16, wherein the second ground body portion extends substantially orthogonal to the pair of second ground contact portions and the second ground coupling portion.

18. The electrical connector according to claim 1, wherein the first ground contact and the second ground contact are formed from a common stamped blank pattern.

19. An electrical connector comprising:

an insulative contact support having a body and a tongue extending from the body;

a first signal contact having a first signal body portion and a first signal contact portion extending substantially orthogonal from a first end of the first signal body portion, the first signal contact portion positioned on a first surface of the tongue;

a first ground contact positioned proximate to the first signal contact and having a first ground coupling portion and a pair of first ground contact portions extending substantially orthogonal from the first ground coupling portion, the pair of first ground contact portions stepped from each other such that one of the pair of first ground contact portions is positioned adjacent to the first signal contact portion on the first surface and another of the pair of first ground contact portions positioned opposite the first signal contact portion on a second surface of the tongue;

a second signal contact positioned adjacent the first signal contact and having a second signal body portion and a second signal contact portion extending substantially orthogonal from a second end of the second signal body portion, the second signal contact portion positioned adjacent to the first signal contact portion on the first surface; and a second ground contact positioned adjacent to the second signal contact and having a second ground coupling portion and a pair of second ground contact portions extending substantially orthogonal from the second ground coupling portion, the pair of second ground contact portions stepped from each other such that one of the pair of second ground contact portions is positioned adjacent to the second signal contact portion on the first surface and another of the pair of second ground contact portions is positioned opposite the second signal contact portion on the second surface of the tongue.

20. The electrical connector of claim 19, further comprising a third signal contact positioned adjacent the first ground contact and having a third signal body portion and a third signal contact portion extending substantially orthogonal from an end of the third signal body portion, the third signal contact portion positioned adjacent the other of the pair of first ground contact portions positioned on the second surface.

21. The electrical connector of claim 20, wherein the third signal body portion is shorter than the first signal body portion and the second signal body portion.

22. The electrical connector of claim 21, wherein the third signal contact portion is positioned transverse to the first signal contact portion.

23. The electrical connector of claim 22, wherein the third signal contact portion is aligned opposite the one of the pair of first ground contact portions that is positioned on the first surface.

24. The electrical connector of claim 23, further comprising a fourth signal contact positioned adjacent the second ground contact and having a fourth signal body portion, and a fourth signal contact portion extending from an opposite end of the fourth signal body portion, the fourth signal contact portion positioned adjacent the other of the pair of second ground contact portions positioned on the second surface.

25. The electrical connector of claim 24, wherein the fourth signal body portion is shorter than the first signal body portion and the second signal body portion.

26. The electrical connector of claim 25, wherein the fourth signal contact portion is positioned transverse to the second signal contact portion.

27. The electrical connector of claim 26, wherein the fourth signal contact portion is aligned opposite the other of the pair of second ground contact portions positioned on the first surface.

28. The electrical connector according to claim 19, wherein the first ground contact includes a first ground terminating portion extending from the first ground coupling portion and being aligned between the pair of first ground contact portions.

29. The electrical connector according to claim 28, wherein the second ground contact includes a second ground terminating portion extending from the second ground coupling portion and being aligned between the pair of second ground contact portions.

30. The electrical connector according to claim 19, further comprising a shell covering the insulative contact support.

31. The electrical connector according to claim 30, wherein shell includes a mating connector receiving passageway.

32. The electrical connector according to claim 19, wherein the first ground contact and the second ground contact are formed from a common stamped blank pattern.

* * * * *